United States Patent [19]

Shields

[11] 4,253,582

[45] Mar. 3, 1981

[54] EASY-OPEN CONTAINER END

[76] Inventor: Michael R. Shields, 262 Fishing Creek Rd., Cape May, N.J. 08204

[21] Appl. No.: 111,533

[22] Filed: Jan. 14, 1980

[51] Int. Cl.[3] ..... B65D 41/32

[52] U.S. Cl. ..... 220/269; 220/270

[58] Field of Search ..... 220/269-273

[56] References Cited

U.S. PATENT DOCUMENTS

| | | | |
|---|---|---|---|
| 3,730,380 | 5/1973 | Silver | 220/269 |
| 3,836,038 | 9/1974 | Cudzik | 220/270 X |
| 3,847,300 | 11/1974 | Waters | 220/269 |

*Primary Examiner*—George T. Hall

*Attorney, Agent, or Firm*—Thomas A. Lennox

[57] ABSTRACT

A plastic easy-open container end including a score line in the end wall with a finger pull tab which pulls the tear strip away from the edge of the end wall toward the center of the can with a pressure knob extending from the pull tab with the knob positioned to be secured in a snap to hold the tear strip open and away from the pour opening.

14 Claims, 14 Drawing Figures

EASY-OPEN CONTAINER END

BACKGROUND OF THE INVENTION

My invention relates to easy-open containers and in particular container ends which might be most easily pictured as pull top cans. My invention is directed to containers wherein the pull top is not detachable. In particular, my invention is useful for containers wherein the container end with the pull top is manufactured of a polymeric plastic, typically a thermoplastic molding compound wherein the entire assembly may be injection molded in one piece.

Most present pull top ends have a top section that either completely separates from the can or is merely bent back along a fold line. These tear strips can easily work loose from the can, increase litter and a safety hazard to the user or to the person stepping on the discarded piece. The tops of cans are typically constructed of aluminum or steel and leave sharp edges on the tear strip as well as the can. These edges are a safety hazard to children or even adults as these parts must be handled with utmost care.

The easy-open cans have enjoyed ready acceptance for such can products as beverages, including carbonated beverages, such as beer, soft drinks and the like, as well as other products such as puddings, fruit juice and the like. These easy opening cans have not yet been used for granular products such as sugar, spices, drink mixes and other such items, possibly because of the inability to produce such an item from a polymeric plastic in a construction that will not cause significant difficulties.

While metal will generally take a permanent set when substantially folded, most plastics will not react in the same fashion and will tend to return to their original shape. This is particularly true with polymeric plastics such as polyethylene, polypropylene, polyvinyl chloride, acrylonitrile styrene polymers and copolymers and the like. Thus, if a pull tab were constructed of a like polymeric material, it would tend to return to the opening from which it was torn. The user would have to hold the tab back out of the way causing great inconvenience and loss of effectiveness. A typical easy opening container is described in U.S. Pat. No. 3,437,227 to H. A. Peyser. This opener pulls toward the center of the can, but leaves the jagged tear strip in place. Another typical end assembly is that easy open container described in U.S. Pat. No. 4,108,302 to Richard A. Patterson. Another easy open can is described in U.S. Pat. No. 3,900,128 to Omar L. Brown.

Some container tops have directed attention to holding the tear strip out of the way such as in U.S. Pat. No. 3,386,613 to B. J. Traynor and U.S. Pat. No. 3,847,300 to Lyle E. Waters. Both of these devices attach over or onto the rim of the can top. A plastic cover for press-in cover cans is described in U.S. Pat. No. 3,246,792 to T. G. W. Brackmann et al with tongue or flap means to oppose the tendancy of the elastic hinge strip to bring the cover back to closed position. A snap on container lip with fold back drink opening is described in U.S. Pat. No. 3,994,411 to Walter Elfelt wherein a flap is inserted into a slit in the removable lid snapped on to a plastic or paper container.

None of these devices satisfy the above needs nor the objects listed hereinbelow.

It is an object of this invention to provide a container end that may be constructed of materials that will not leave a cutting or jagged edge, but will solve the problems associated with such materials that will not take a permanent set when substantially folded.

It is an object of this invention to provide a pull top tear strip construction that will remain out of the user's way after opening, but may be reclosed.

It is an additional object of this invention to provide a container end, such as a can top in which the entire top including the tear strip, the pull tab and a hold down device may be molded in one piece from a thermoplastic polymer.

It is an additional object of this invention to hold down mechanism which is simple and inexpensive which will prevent a tear strip molded of a thermoplastic material tendancy to return to the opening away from that opening.

It is a further object of this invention to provide a hold down system to prevent the tear strip from yielding to the tendancy to return to the opening without breaching the integrity of the can interior, at least until the tear strip has been torn from its position sealing the can.

It is a specific object of this invention to provide a pull tab which may be easily grasped and lifted before pulling on the tear strip to form the opening in the container.

It is an object of this invention to provide an easy open container end in a container in which the end is sealed to the container to protect the contents of the container from adulteration, spoilage and leaking.

It is particular object of this invention to provide a tear strip in the container end that may be easily started and ripped to form the pour opening.

It is an additional object of this invention to provide a container end useful in sealing and providing an easy open end construction for sanitized containers, such as vials and ampules.

SUMMARY OF THE INVENTION

My invention is an easy-open container end with one of the primary uses being that of a can top. While this container end is preferably molded of a thermoplastic polymer, the balance of the container may be plastic or may be of a metal such as aluminum or tin plate. The end wall is sealed to the container, forming an edge around the periphery of the end wall to provide a container sealed from the elements to prevent adulteration or leakage of the contents. The container end includes a score line in the end wall with the score line defining a tear strip having a starting end near the edge of the end wall and a terminal end leaving the strip permanently attached to the remainder of the end wall. A finger pull tab is secured near the starting end of the tear strip with the pull tab including a free end to pull the strip away from the end wall severing it along the score line to form a pour opening. The score line is not joined leaving a significant distance between the ends of the score line so as to cause the strip to remain attached to the container end. A pressure knob extends from the pull tab ring shaped and positioned to fit in a knob fastening and securing device is placed in the end wall positioned to receive and hold the pressure knob in essentially a snap fit when the finger pull tab has been used to pull the tear strip open to define the pour opening and thus hold the tear strip away from the pour opening and out of the way. The securing device is constructed so as to not breach the integrity of the container through the end wall at least until the tear strip has been pulled creating the pour opening in the end wall.

The term "pour opening" as used throughout the specification and claims is intended to include all shapes of openings desired in containers. The term includes not only small openings as illustrated herein, but also openings which lay open up to one-half of end area. The shape of the "opening" is not considered critical to my invention.

BRIEF DESCRIPTION OF DRAWINGS

Other objects, features and advantages will become apparent from the description when taken into conjunction with the following drawings.

DESCRIPTION OF PREFERRED EMBODIMENTS

Figure 1:
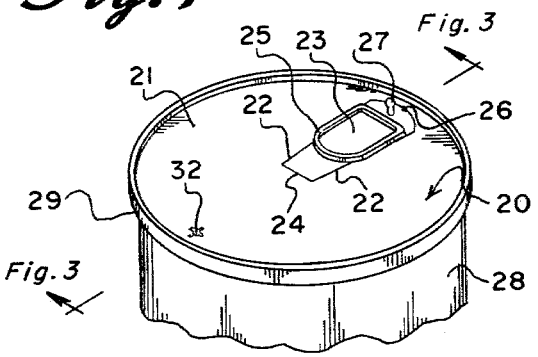
FIG. 1 is a perspective view of a can top of my invention i-the closed position.
Figure 2:
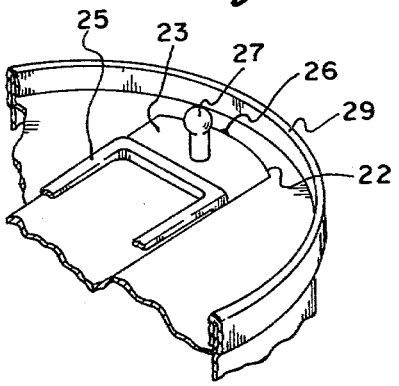
FIG. 2 is an expanded close-up view of the pressure knob extending from the can top of FIG. 1.
Figure 3:
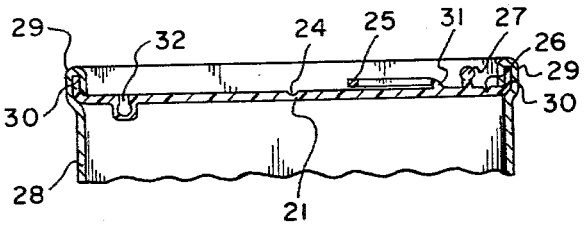
FIG. 3 is a cross-sectional view along Lines 2—2 of FIG. 1.

In FIG. 1 can end assembly 20 is primarily an injection molded end wall 21 on which deep scoring 22 defines a tear strip 23 which folds back along hinge line 24 when finger pull tab 25 is pulled out and toward the center of can end 21. Stress point 26 is provided such that tear strip 23 may be torn away from end 21 easily. The thickness of end wall 21 depends upon the composition of the plastic polymer, copolymer or terpolymer but in this construction is about 60 mils thick polypropylene. After score 22 has been cut in end wall 21, the thickness along the score line is about 10 mils thick. Pressure knob 27 extends upwardly from the top of tab 25 near stress point 26. Can side wall 28 is crimped at 29 over can end assembly 20. As shown in FIG. 2, a close-up view of stress point 26 is shown in scoring 22 with knob 27 projecting upwardly as part of the same molding from strip 23. In FIG. 3 crimped can top 29 extends over and around upright edge 30 holding can end assembly 20 in place. Finger pull tab 25 is secured as part of the same molding at starting end 31 which when pulled will initially break at stress point 26 and fold back against end wall 21 at hinge line 24. Undercut cavity 32 is molded in end wall 21 at a position to receive pressure knob 27.

Figure 4:
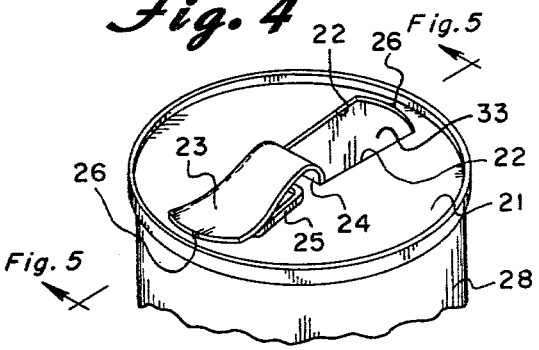
FIG. 4 is a perspective view of the can top shown in FIG. 1 in the open position.
Figure 5:
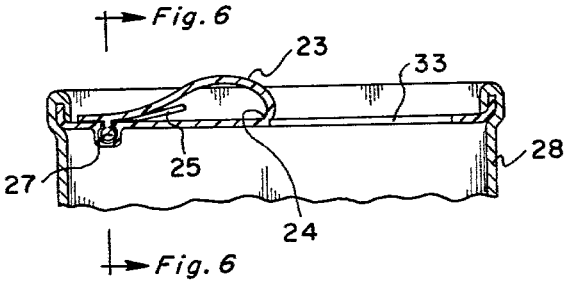
FIG. 5 is a cross-sectional view taken along Lines 5—5 of FIG. 4.
Figure 6:
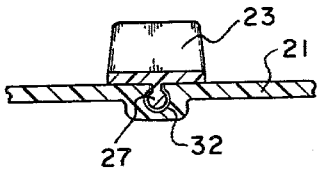
FIG. 6 is an expanded cross-sectional view taken along Lines 6—6 of FIG. 5.
Figure 7:
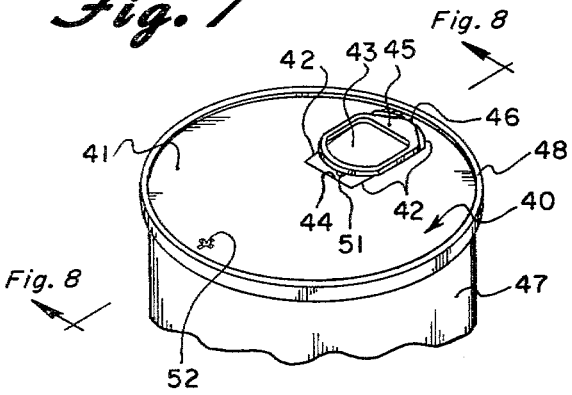
FIG. 7 is a perspective view of a can top of my invention in the closed position.
Figure 8:
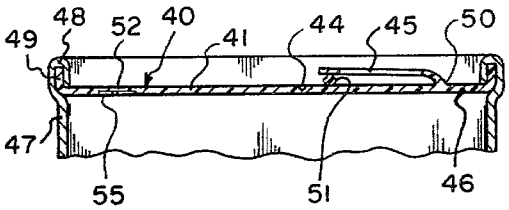
FIG. 8 is a cross-sectional view along Lines 8—8 of FIG. 7.

In FIG. 4 pour opening 23 has been formed by pulling on pull tab 25, ripping rear strip 23 along scoring line 22 and engaging pressure knob 27 in cavity 32. Hinge 24 allows tear strip 23 to extend relatively flat across and above end wall 21. FIG. 5 shows a cross-sectional view of engagement of pressure knob 27 in undercut snap cavity 32 holding pull tab 25 in place and tear strip 23 out of the way of pour opening 33. FIG. 6 is an expanded cross-sectional view of pressure knob 27 in snap cavity 32 to hold tear strip 23 in place in the open position. In this assembly, end wall 21, tear strip 23, finger pull tab 25 and pressure knob 27 are all injection molded in one piece. An airtight closure can be maintained while providing the opening capabilities described hereinabove. By shaping scoring line 22 such that stress point 26 is formed, initial primary stress is placed at that point when finger pull-tab 25 is pulled, starting the tear which will allow tear strip 23 to be opened exposing pour opening 33. In FIG. 7 can end assembly 40 is an injection molded end wall 41 on which deep scoring 42 defines a tear strip 43 extending about one-third the diameter across end 41. Strip 43 folds back along hinge line 44 and finger pull tab 45 is pulled out and toward the center of can end 41. Stress point 46 is provided such that tear strip 43 may be torn away from end 41 easily. End wall 41 is about 40 mils thick. After score 42 has been cut in end wall 41, the thickness along the score line is about 3 mils thick. Pressure knob 51 extends downwardly under finger pull tab 45 and rests on the outer surface of end wall 41. Can side wall 47 is crimped at 48 over can end assembly 40. In FIG. 8, crimped can top 48 extends over and around upright edge 49 sealing can end assembly 40 in place. Finger pull tab 45 is secured as part of the same molding to end 41 at starting end 50 which when pulled will initially break at stress point 46 and fold back against end wall 41 at hinge line 44. Pressure knob 51 extends as part of the same molding from the under side of the distal portion of finger pull tab 45 and rests on the outside surface of end wall 41 in the closed position. A break through star cut is molded under point 52 to receive pressure knob 51.

Figure 9:
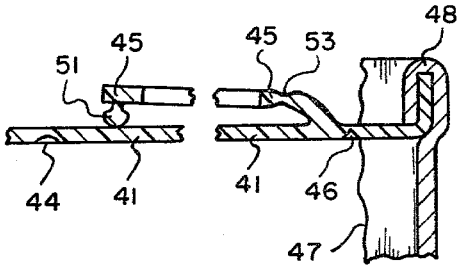
FIG. 9 is an expanded view of a section of the cross-sectional view of FIG. 8.
Figure 10:
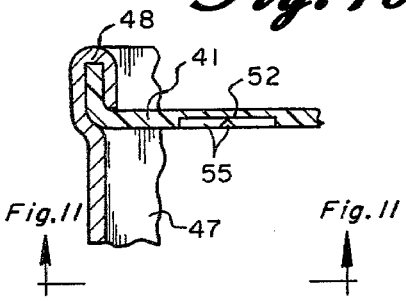
FIG. 10 is an expanded partial cross-sectional view along a section of FIG. 8.
Figure 11:
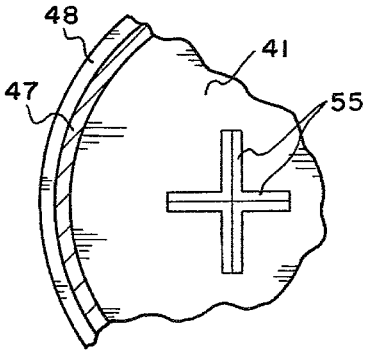
FIG. 11 is a bottom view from inside the can of a securing device for the pressure knob.

In FIG. 9 an expanded partial cross-section showing some of the detail in FIG. 8 shows more clearly stress point 46 of score line 42 as well as hinge 53 in finger pull tab 45. The shape of knob 51 pressing on end wall 41 is more clearly shown in this view. Cross cut 55 is essentially two deep crossing grooves about 90% in depth of thickness of can end 41. A cross-sectional view of this cross is illustrated in FIG. 10 showing in an expanded view the intersection of the deep cut under point 52 marked in same way. In FIG. 11 the fastening means of cross-cut grooves 55 is illustrated by a view of the under side 57 of can end 41 near can edge 58.

Figure 12:
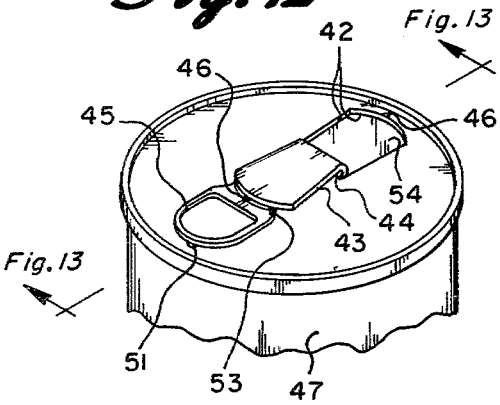
FIG. 12 is a perspective view of the can top shown in FIG. 7 in the open position.
Figure 13:
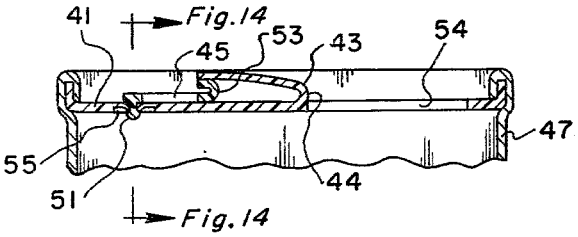
FIG. 13 is a cross-sectional view taken along Lines 12—12 of FIG. 12.
Figure 14:
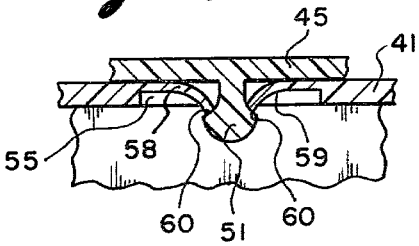
FIG. 14 is an expanded cross-sectional view from FIG. 13 of the same section viewed in FIG. 10 with the pressure knob pressed in and held in the container top.

In the perspective view of FIG. 12, pour opening 54 has been formed by pulling on pull tab 45, ripping tear strip 43 along scoring line 42 and pressing pressure knob 51 at point 52 to break through wall 41 and secure the knob 51. Hinge 44, as well as hinge 53 allows the combination of the length of pull tab 45 and tear strip 43 to extend relatively flat across and above end wall 41. FIG. 13 shows a cross-sectional view of engagement of pressure knob 51 after it has been snapped through cross-cut 55 holding pull tab 45 in place and tear strip 43 out of the way of pour opening 24. In FIG. 14 a cross-sectional view shows snap knob 57 after it has been pressed through cross-cut 55 breaking through can end 41 at break point 52. The severed marginal portions 58 and 59 engage under cut surface 60 of snap knob 51 to hold pull ring 45 in place. In this embodiment end wall 41, tear strip 43, finger pull tab 45 and pressure knob 51 are all injection molded in one piece of acrylonitrile butadiene styrene endopolymer. When can assembly 40 is in the closed position pressure knob 51 extending generally downwardly from the distal portion of finger pull tab 43 serves a second useful purpose resting on end wall 41 by holding finger pull tab 45 off the surface of end wall 41, allowing tab 45 to be more easily grasped and pulled to start the tear strip 43. In the embodiment of FIG. 1 utilizing undercut snap cavity 32, end wall 21 is not breached until pour opening 33 is exposed. Likewise, when cross-cut grooves 55 are utilized to hold snap knob 51, the breach of end wall 41 occurs only after pour cavity 54 has been opened. Thus, the can and assembly remains secure until the pour opening has been purposely exposed. This embodiment uses only one hand.

The prior examples of my invention are merely illustrative of my invention and are not intended to limit the scope of a patent grant. My invention is limited only by the appended claims.

I claim:

1. An easy-open container end comprising:

(a) an end wall panel permanently sealed to container forming an edge around the periphery of the end wall, (b) a score line, in the end wall defining a tear strip, having a starting point on the end wall near the edge and a terminal point leaving the strip permanently attached to the remainder of the end wall, (c) a finger pull tab means secured to the starting end of the tear strip, the tab means including a free end to pull the strip away from the end wall severing along the score line to form a pour opening, (d) a pressure knob extending from the finger pull tab means, and (e) a knob securing means in the end wall positioned to receive and hold the pressure knob when the finger pull tab means has been used to pull the tear strip open to define the pour opening, wherein the securing means does not breach the integrity of the container at least until the pressure knob is secured in the securing means for the first use.

2. The container end of claim 1 wherein the end wall is constructed of a polymeric plastic material.

3. The container end of claim 2 wherein the tear strip, finger pull tab means and knob are all molded in one piece with the container end.

4. The container end of claim 1 wherein the score line proximate to the edge of the container end is shaped as a point at which the initial primary stress is placed on the score line when pulling on the finger pull tab means.

5. The container end of claim 1 wherein the knob fastening means is an undercut cavity in the container end which does not open to the inside of the container end.

6. The container end of claim 1 wherein the knob receiving and fastening means comprises at least two crossing score lines cut from the inner side of the container end, of sufficient depth to allow the pressure knob to be forced through the break of the score lines at their intersection, and held by the severed marginal portions.

7. An easy-open container end comprising:

(a) an end wall panel, (b) a score line in the end wall defining a tear strip having a starting end near the edge of the end wall and a terminal end permanently attached to the remainder of the end wall, (c) a finger pull tab means secured to the starting end of the tear strip, the tab means including a free end to pull the strip away from the end wall severing along the score line to form a pour opening, (d) a pressure knob extending from the distal part of the finger pull tab means in a generally downwardly direction, and (e) a knob fastening and securing means in the end wall positioned to receive and hold the pressure knob when the finger pull tab means has been used to pull the tear strip open to define the pour opening.

8. The container end of claim 7 wherein the end wall is constructed of a polymeric plastic material.

9. The container end of claim 8 wherein the tear strip, finger pull tab means and knob are all molded in one piece with the container end.

10. The container end of claim 7 wherein the score line proximate to the edge of the container end is shaped as a point at which the initial primary stress is placed on the score line when puling on the finger pull tab means.

11. The container end of claim 7 wherein a hinge means is constructed proximate to the connection between the finger pull tab means and the tear strip starting end.

12. The container end of claim 7 wherein the pressure knob projects downwardly under the distal portion of the finger pull tab means to rest on the container end surface and hold the finger pull tab means off of the surface, before the score line is severed.

13. The container end of claim 7 wherein the knob receiving and fastening means is an undercut cavity in the container end which does not open to the inside of the container end.

14. The container end of claim 7 wherein the knob receiving and fastening means comprises at least two crossing score lines cut from the inner side of the container end, of sufficient depth to allow the pressure knob to be forced through the break of the score lines at their intersection, and held by the severed marginal portions.

* * * * *